US006809699B2

(12) United States Patent
Chen et al.

(10) Patent No.: US 6,809,699 B2
(45) Date of Patent: Oct. 26, 2004

(54) DIPOLE ANTENNA ARRAY

(75) Inventors: I-Fong Chen, Tao-Yuan (TW); Chia-Mei Peng, Pingchun (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 10/351,305

(22) Filed: Jan. 27, 2003

(65) Prior Publication Data

US 2004/0145532 A1 Jul. 29, 2004

(51) Int. Cl.[7] ..... H01Q 9/28

(52) U.S. Cl. ..... 343/795; 343/793; 343/802; 343/822

(58) Field of Search ..... 343/792.5, 793, 343/795, 802, 818, 820–823

(56) References Cited

U.S. PATENT DOCUMENTS 4,814,783 A * 3/1989 Shelton et al. ..... 343/795
5,898,410 A * 4/1999 DeMarre ..... 343/792.5
6,483,476 B2 * 11/2002 Cox ..... 343/815

FOREIGN PATENT DOCUMENTS

JP 05-037226 * 12/1993 ..... H01Q/9/16

* cited by examiner

*Primary Examiner*—Shih-Chao Chen

(74) *Attorney, Agent, or Firm*—Troxell Law Office PLLC

(57) ABSTRACT

The dipole antenna array is formed by connecting a plurality of dipole antennas, one end of the dipole antenna array has an open stub and a balancing circuit to adjust the width of frequency band, impedance and gain of the antenna array. Each dipole antenna is added on the two ends thereof with antenna loading devices such as a plurality of mini-aperture antennas. The dipole antenna array can have an option to add a reflector on an end thereof.

2 Claims, 4 Drawing Sheets

DIPOLE ANTENNA ARRAY

BACKGROUND OF THE INVENTION

1. Field of the Invention

The present invention is related to a dipole antenna array, and especially to an antenna array of which dipole antennas are taken as a basis to form an antenna array, thereby the width of frequency band and gain can be increased to provide the functions of dual frequency or multiple frequency antennas.

2. Description of the Prior Art

In the primary stage of marketing of mobile phones, exposed helical coils structures are used as the main components of antennas. The coil antennas widely used nowadays are generally divided into two main types—contractible and fixed types. No matter which kind of structure is used, an antenna normally has a specific length protruding out of the top surface of the body of a mobile phone. Therefore, various microstrip antennas have been developed, such microstrip antennas are characterized by planeness, concealment and non occupying too much volume.

The microstrip antennas disclosed in the U.S. Pat Nos. 3,921,177 and 3,810,183 are generally composed of round or rectangular metallic sheets, there are dielectrics filled between the antennas and the ground; however, such microstrip antennas only allow narrower widths of frequency. Taiwan patent no. 81,108,896 (with a U.S. patent application filing number of 07/798700) provides a microstrip antenna being reduced by size but with a broadband. However, it has the defect of providing a helical antenna component on a grounding floor separating therefrom, and a dielectric with a specific thickness and loading material are provided therebetween, the size of the antenna is still hard to further be reduced though.

Among modern planar inverted F-antennas (PIFA), dual-frequency antennas (IEEE TRANSACTIONS ON ANTENNAS AND PROPAGATION, VOL 45, NO.10, OCTOBER 1997) are of an ideal type of miniaturized microstrip antenna, however, by the fact that:

$$\frac{\text{Electrical volume of an antenna}}{\text{frequency band} \times \text{gain} \times \text{efficiency}} = a \text{ constant}$$

So long as the antenna is made planar and miniaturized, its bandwidth and efficiency of radiation will be reduced and will be necessary to be improved.

SUMMARY OF THE INVENTION

The object of the present invention is to provide a dipole antenna array that can solve the problem of insufficiency of the widths of frequency bands and radiating efficiencies of microstrip antennas, and can effectively suit various portable communication equipments as dual frequency or multiple frequency antennas.

To get the above stated object, the present invention provides a dipole antenna array by connecting a plurality of dipole antennas, one end of the dipole antenna array has an open stub and a balancing circuit to adjust the width of frequency band, impedance and gain of the antenna array.

In a further embodiment, each dipole antenna is added on the two ends thereof with antenna loading devices such as a plurality of mini-aperture antennas.

In an ideal embodiment, the above stated dipole antenna array can have an option to add a reflector to increase its gain.

The present invention will be apparent in its novelty and other characteristics after reading the detailed description of the preferred embodiment thereof in reference to the accompanying drawings. Wherein:

DETAILED DESCRIPTION OF THE PREFERRED EMBODIMENT

Figure 1:
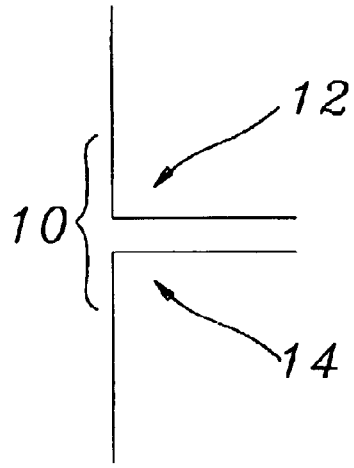
PRIOR ART FIG. 1
FIG. 1 is a schematic view showing the structure of a conventional dipole antenna.

Referring to FIG. 1, a dipole antenna 10 mainly has two microstrip antennas 12, 14 arranged mutually oppositely for obtaining a desired frequency. This can also have the defect of a miniaturized microstrip antenna, i.e., reducing of the width of frequency band and radiating efficiency, and thereby is hard to suit various portable communication equipments at the present time.

Figure 2:
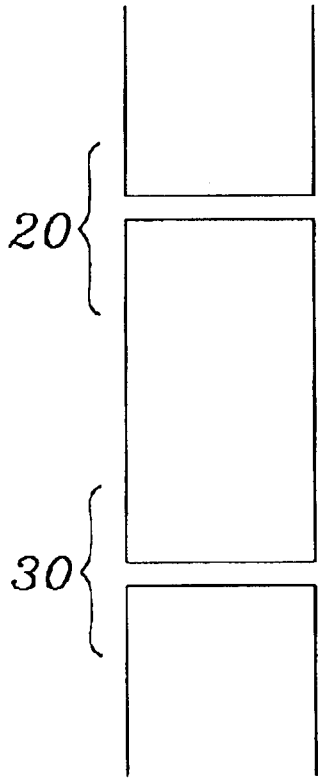
FIG. 2 is a schematic view showing the first embodiment of the present invention.
Figure 3:
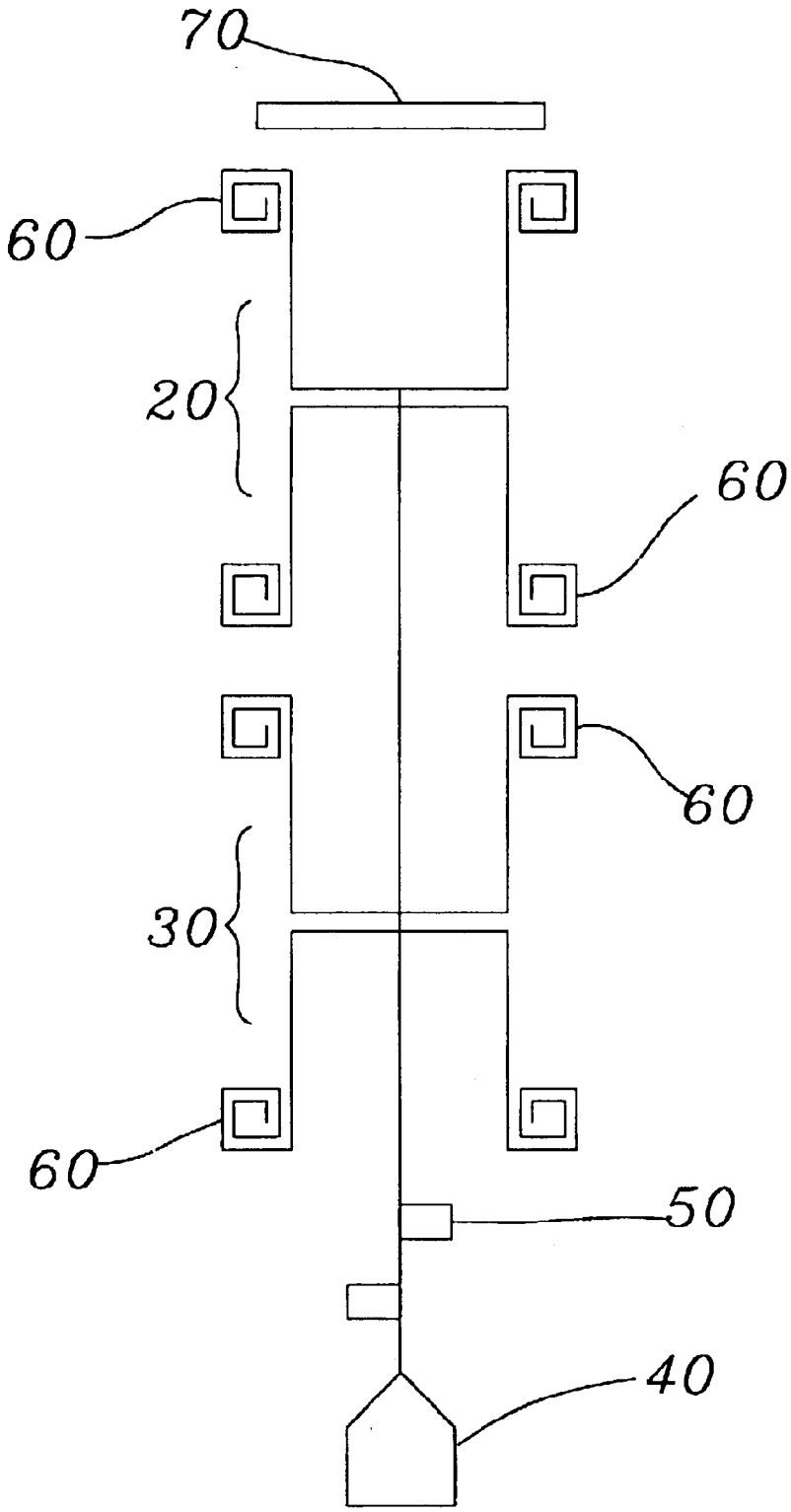
FIG. 3 is a schematic view showing a further embodiment of the present invention derived from FIG. 2.
Figure 4:
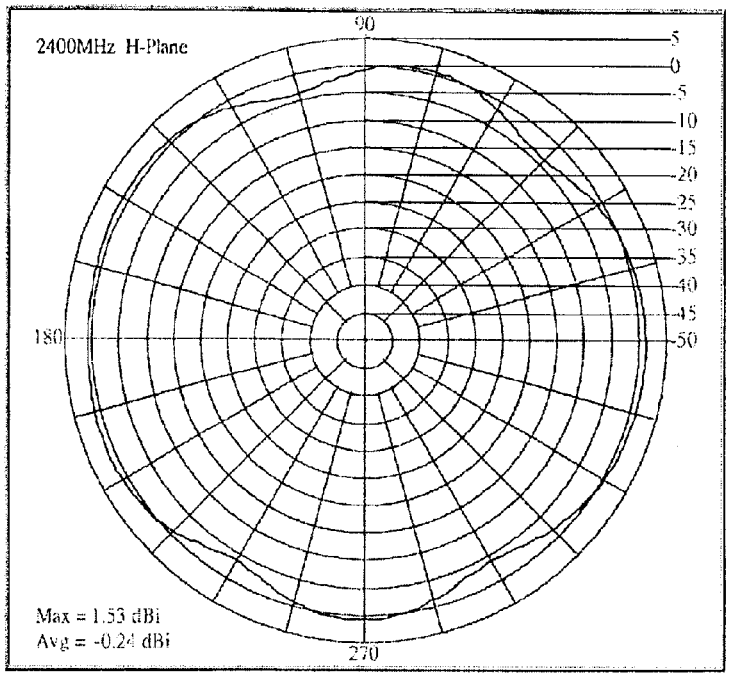
FIG. 4 is a schematic view showing an electromagnetic test diagram of an H plane under 2400 Hz.
Figure 5:
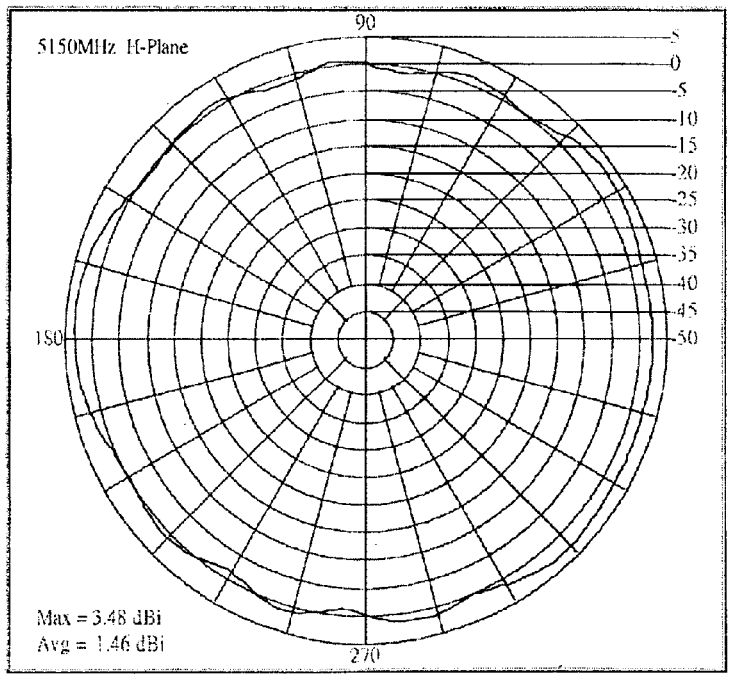
FIG. 5 is a schematic view showing an electromagnetic test diagram of an H plane under 5150 Hz.

Referring to FIG. 2, in the present invention, dipole antennas are taken as a basis, a plurality of dipole antennas 20, 30 are strung together to form a microstrip antenna array. Thereby the width of frequency band and gain of the microstrip antennas can be increased effectively, and the antenna array can be widely used on various portable communication equipments.

In the further embodiment of the present invention as shown in FIG. 2, one end of the above stated dipole antenna array has a balancing circuit 40 and an open stub 50 to adjust the width of frequency band, impedance and gain of the antenna array.

Meantime, in the embodiment, each of the dipole antennas 20, 30 is added on the two ends thereof with antenna loading devices which had better are a plurality of mini-aperture antennas 60. The mini-aperture antennas 60 are used as the electric induction loadings, and are provided with the function of reducing the electrical length, and can form a harmonic frequency. Thereby, the entire dipole antenna array stated above has the function of a dual frequency or multiple frequency antenna.

In a more ideal embodiment, the above stated dipole antenna array can have an option to add a reflector 70 on one end thereof to increase the gain of the entire antenna array.

Figure 6:
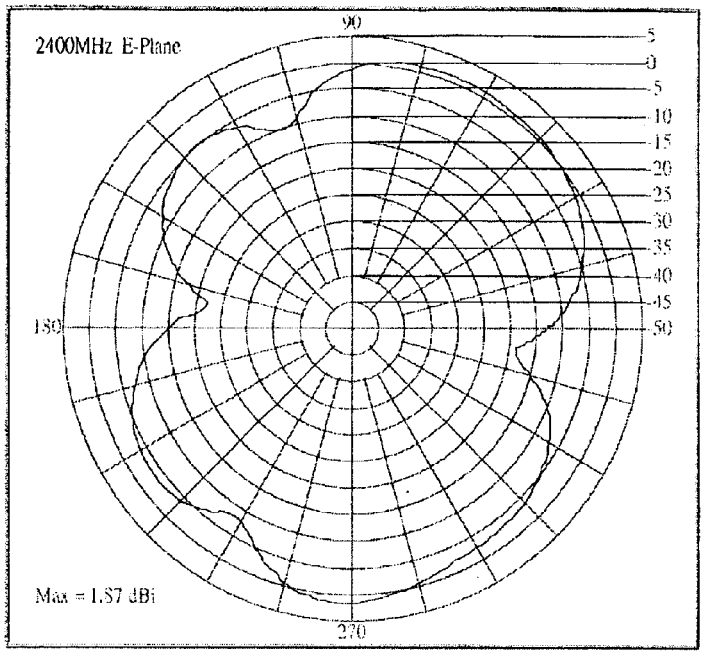
FIG. 6 is a schematic view showing an electromagnetic test diagram of an E plane under 2400 Hz.
Figure 7:
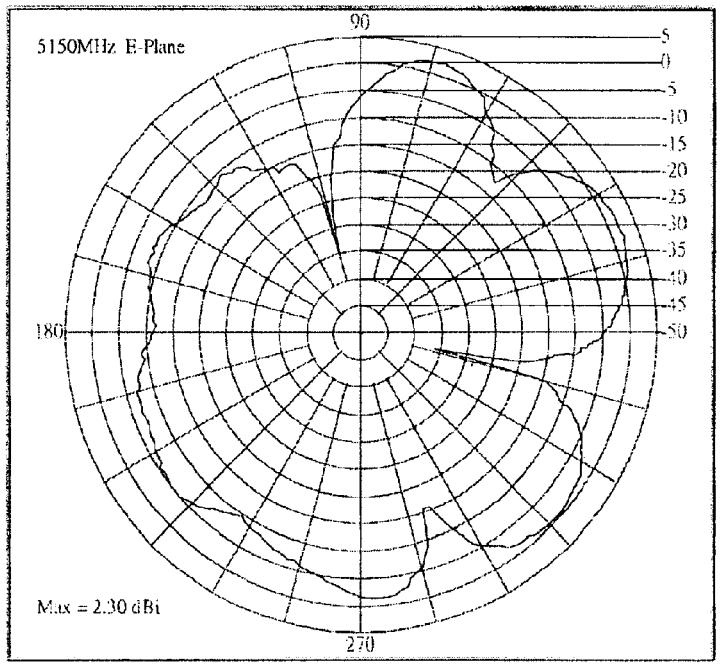
FIG. 7 is a schematic view showing an electromagnetic test diagram of an E plane under 5150 Hz

In the electromagnetic test diagrams as shown in FIGS. 4–7, FIGS. 4, 5 are electromagnetic test diagrams of an H plane under 2400 Hz and 5150 Hz respectively; FIGS. 6, 7 are electromagnetic test diagrams of an E plane under 2400 Hz and 5150 Hz respectively. It can be seen that they all have good multiple frequency functions.

The present invention accordingly is able to solve the problem of insufficiency of the widths of frequency bands and radiating efficiencies of microstrip antennas, and to effectively suit various portable communication equipments; thereby, it surely has an industrial value.

The preferred embodiment disclosed above is only for illustrating the present invention. It will be apparent to those skilled in this art that various modifications or changes can be made without departing from the spirit of this invention. Accordingly, all such modifications and charges also fall within the scope of the appended claims and are intended to form part of this invention.

What is claimed is:

1. A dipole antenna array comprising:

a) a plurality of dipole antennas connected together and forming an antenna array, each of the plurality of dipole antennas having a plurality of mini-aperture antennas located on two ends thereof;

b) an open stub; and c) a balancing circuit adjusting a width of frequency band, impedance, and gain of the antenna array, the open stub and the balancing circuit are located on an end of the antenna array.

2. The dipole antenna array according to claim 1, further comprising a reflector located on an end of the antenna array opposite the open stub and the balancing circuit.

* * * * *